US005871422A

United States Patent [19]

Elbogen

[11] Patent Number: 5,871,422

[45] Date of Patent: Feb. 16, 1999

[54] PORTABLE MUSCULATURE EXERCISING DEVICE

[76] Inventor: Steven D. Elbogen, 5059 Newport Ave., #104, San Diego, Calif. 92107

[21] Appl. No.: 5,665

[22] Filed: Jan. 12, 1998

Related U.S. Application Data

[62] Division of Ser. No. 823,521, Mar. 24, 1997.

[60] Provisional application No. 60/037,567, Feb. 8, 1997.

[51] Int. Cl.[6] ..... A63B 21/04

[52] U.S. Cl. ..... 482/40; 482/904; 482/96

[58] Field of Search ..... 482/904, 121, 482/104, 38, 91, 134, 66, 124, 133, 40

[56] References Cited

U.S. PATENT DOCUMENTS

| | | | |
|---|---|---|---|
| 3,119,614 | 1/1964 | Berry | 482/91 |
| 4,789,154 | 12/1988 | Mattox | 482/10 |
| 4,949,956 | 8/1990 | Pobran | 482/38 |
| 5,417,628 | 5/1995 | Vanderbleek | 482/904 |
| 5,558,609 | 9/1996 | Olschansky et al. | 482/124 |
| 5,571,064 | 11/1996 | Holm | 482/904 |

FOREIGN PATENT DOCUMENTS

| | | | |
|---|---|---|---|
| 2403088 | 4/1979 | France | 482/904 |
| 92003191 | 3/1992 | WIPO | 482/124 |

*Primary Examiner*—Jerome W. Donnelly
*Attorney, Agent, or Firm*—Henri J. A. Charmasson; John D. Buchaca

[57] ABSTRACT

A portable musculature exerciser designed to be mounted against a door provides a pair of parallel bars jutting out from the face of the door as well as a horizontal chin-bar for use in a variety of exercises. The back of the door provides a dorsal support in the performance of some of those exercises. The device comprises a generally U-shaped grab-bar suspended by a triple-strap yoke to a ribbon-like tail. The tail has a series of protrusions spaced apart along its length. When the tail is swung over the top of a door and the door is closed against its frame, one of the protrusions caught between the top edge of the door and its lintel prevents the tail from slipping out. The grab-bar can be knocked down into three elongated parts that can be conveniently stored in a briefcase or similar enclosure.

6 Claims, 2 Drawing Sheets

PORTABLE MUSCULATURE EXERCISING DEVICE

PRIOR APPLICATION

This is a division of application Ser. No. 08/823,521 filed Mar. 24, 1997, a continuation-in-part of provisional application Ser. No. 60/037,567 filed Feb. 8, 1997. Some of the matter therein was disclosed in Disclosure Document No. 409,735 dated Dec. 24, 1996.

FIELD OF THE INVENTION

This invention relates to portable, personal exercising devices, and more particularly to collapsible devices for home use.

BACKGROUND OF THE INVENTION

Some of the most popular musculature developing and fitness exercises such as pull-ups, dips, pushups and chin-up exercises usually require a variety of equipment such as parallel bars, pull-bars that are seldom seen outside of gymnastic clubs and similar institutions. Combination exercise machines for home use which can be used for those exercises are relatively bulky and expensive.

For beginners, handicapped or elderly persons, some of these exercises such as dips and pull-ups are difficult to perform without some sort of dorsal support. Conventional parallel bars and pull-up bars do not provide such a support.

The invention results from an attempt to devise a compact and inexpensive set of combination pull-bar and dip-bar that can be quickly and conveniently installed in any home environment and can be stored in a minimal storage space.

SUMMARY OF THE INVENTION

The principal and secondary objects of this invention are to provide a simple set of parallel and pull-up bars that can be quickly and safely put in place in a home environment in order to perform pull-up and dipping exercises.

Another object of the invention is to provide such an exercising device in a compact and simple configuration that can be quickly used for a multitude of exercises without expensive modifications of its configuration.

Yet another object of this invention is to combine the advantage of pull-bars and parallel bars with a dorsal support, and thus expand the types and variety of exercises that can be performed therewith.

These and other objects are achieved by means of a simple U-shaped grab-bar that is suspended by a triple-strap harness from a ribbon-like tail that can be wedged between the upper edge of a door and its lintel. The grab-bar can be used with either its open end or its closed end against the face of the door at various adjustable heights in order to provide pull-up and dip exercises with the user's back leaning against the door.

DESCRIPTION OF THE PREFERRED EMBODIMENT OF THE INVENTION

Figure 1:
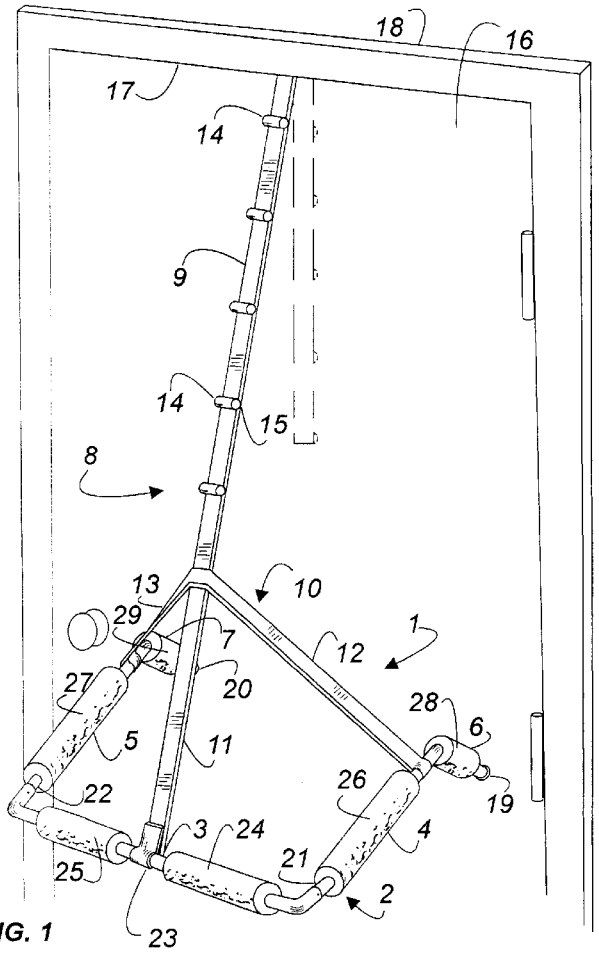
FIG. 1 is a perspective view of the musculature exerciser according to the invention installed against a door.

Referring now to the drawing, there is shown in FIG. 1, a first embodiment 1 of a musculature exercising device according to the invention. The device consists of a U-shaped grab-bar 2 having a central tubular portion 3 and two-arms 4,5 projecting in the same direction and in the same plane as the central portion from opposite thereof. The distal end portions 6, 7 of the arms are obliquely slanted or curved. The grab-bar is suspended by a harness 8 comprising a ribbon-like tail 9 and a yoke 10 framed by three stays 11, 12 and 13. The straps have substantially the same length and have distal extremities joined together to the proximal end of the tail 9. The opposite proximal extremity of the central strap 11 is secured around the middle of the central portion 3 of the grab-bar. The two other straps have each of their proximal extremities secured to one of the arms 4, 5 respectively. A series of protrusions 14 are formed at regular intervals along the ribbon-like tail 9. These protrusions are preferably made by looping the tail around a small segment 15 of a cylindrical rod. The tail is swung over a door 16. The door is then closed so that a section of the tail is caught between the top edge 17 of the door and the adjacent lintel 18.

One of the protrusions 14 immediately behind the top edge of the door rests against the lintel 18 and acts as a barrier preventing the tail from slipping down and out from between the top edge and the lintel.

When the harness 8 is taut as shown in FIG. 1, the grab-bar is suspended in a substantial horizontal position with the two curved ends 6, 7 resting against the face of the door. Small rubber tips 19, 20 are inserted into the open extremities of the slanted ends to protect the door and provide better friction. The proximal ends 21, 22 of the arms are telescopically joined to the central portion, and secured therein by a detent mechanism. Alternately or in addition the central portion itself can be made into two equal portions telescopically joined in the center 23 under the securing loop of the first strap 11. Padding sleeves 24–29 made of resilient foam material are engaged over the two half sections of the central portion 3, the arms and their curved extremities respectively.

Figure 3:
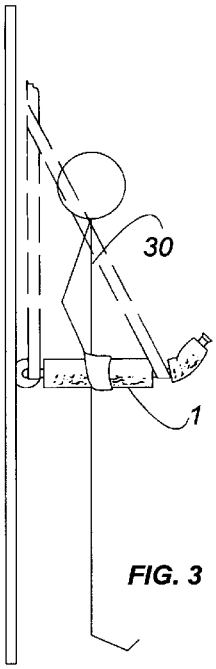
FIG. 3 is a diagrammatical illustration of an exerciser in a parallel bar configuration.

FIG. 3 illustrates the use of the exerciser in a parallel bar configuration where the central portion rests against the door. This configuration and position is particularly adapted to perform dipping exercises where the user 30 raises and lowers himself by flexing his arms.

Figure 4:
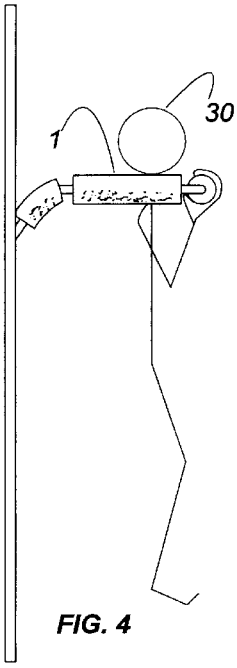
FIG. 4 is a diagrammatical illustration of an exerciser used in a pull-up bar configuration.

FIG. 4 illustrates the use of the exerciser as a pull-bar where the open ends of the grab-bar lean against an upper part of the door. This configuration and position is particularly adapted for use as a pull-bar where the user raises himself by flexing his elbows while grabbing the central portion until his face comes to the level of the grab-bar then slowly lowers himself until his feet touch the ground.

Figure 5:
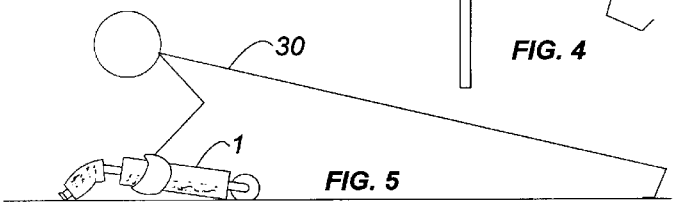
FIG. 5 is a diagrammatical illustration of an exerciser used in a push-up bar configuration.

FIG. 5 illustrates the use of the grab-bar laying on the ground for use in doing pushup exercises. The curved portions 6, 7 are in contact with the ground raising the arms slightly off the ground where they can be easily grabbed by the user.

Figure 6:
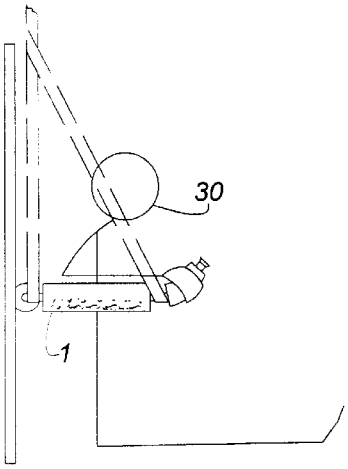
FIG. 6 is a diagrammatical illustration of an exerciser used for abdominal exercises.

FIG. 6 illustrates another use of the exerciser in the parallel bar configuration for the development of abdominal musculature. The user grabbing the curved ends rests his elbows on the arms and brings his legs to a near horizontal position, then lets them return slowly to a normal vertical position.

Figure 2:
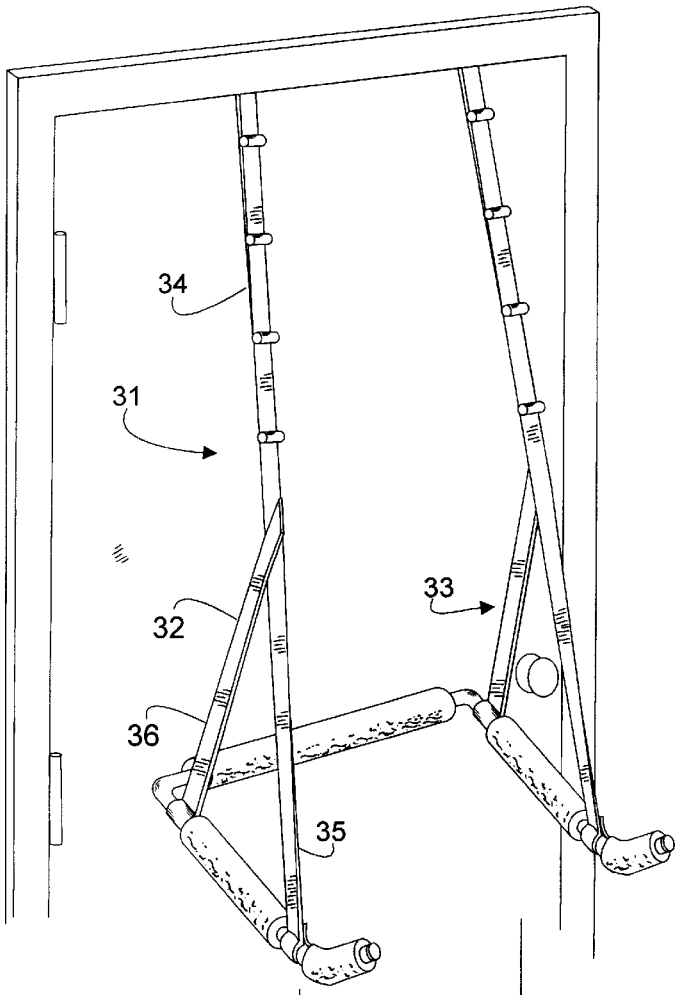
FIG. 2 is a perspective view of an alternate embodiment thereof.

As shown in FIG. 2, an alternate embodiment 31 of the invention uses two harnesses 32, 33 to suspend the grab-bar 2. Each harness consists of a tail 34 similar to the one in the first embodiment, and two straps 35, 36 joined together at their other ends to the proximal end of the tail. The opposite lower ends are attached to opposite ends of the arms astride their padding sleeves.

Figure 7:
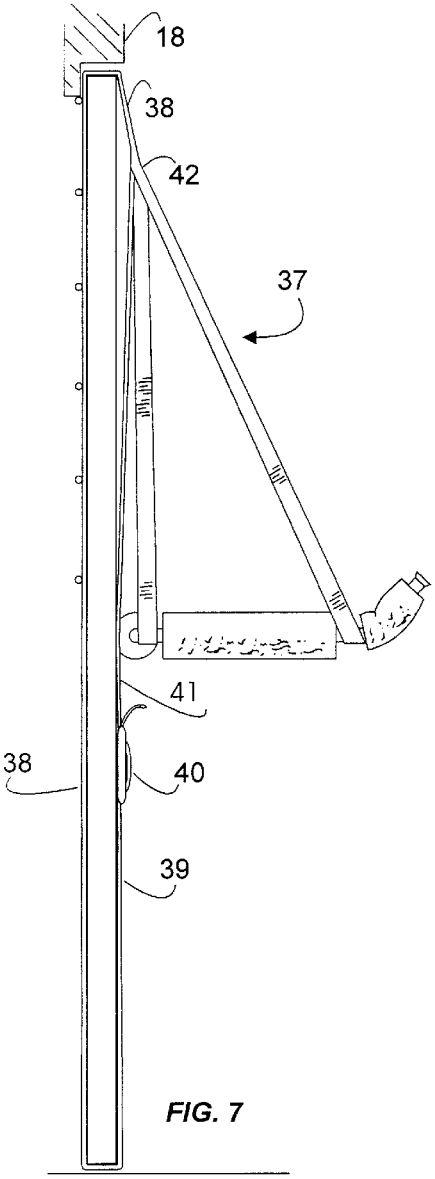
FIG. 7 is a side view of a second alternate embodiment of the invention.

In a third embodiment 37 of the invention illustrated in FIG. 7, the tail or tails 38 is long enough to be looped completely around both faces of the door. The distal end 39 is then secured by a buckle 40 to an appendage 41 hanging from the proximal end 42 of the tail. This version is particularly adapted for a semi-permanent installation of the exerciser to a door, and will remain in place when the door is open.

Figure 8:
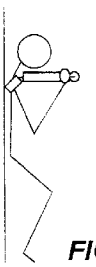
Figure 9:
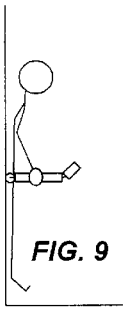
Figure 10:
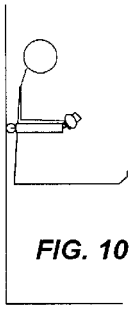

FIGS. 8–10 illustrate the exerciser in the above-described position, but with the user leaning his back against the door during the various dipping, pull-up and abdominal exercises.

Figure 11:
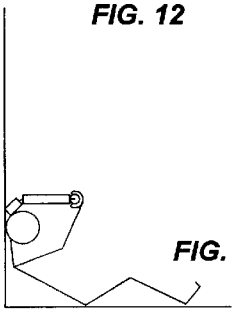

FIG. 11 illustrates the use of the exerciser as a pull-bar in a lower position where the user starts from a recline position on the ground.

Figure 12:
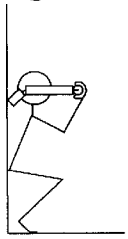
FIGS. 8–13 are diagrammatical illustrations of back-assisted and squat-assisted exercises.
Figure 13:
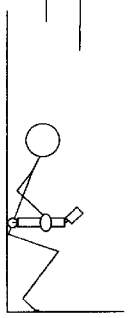

FIGS. 12 and 13 illustrate the use of the exerciser in performing pull-up and dipping exercises respectively while squating and leaning against the door. The same exercises may also be performed without leaning against the door.

The exercises illustrated in FIGS. 7–13 are particularly indicated for elderly, handicapped or physically impaired persons who require the added safety and assistance of the backrest. While the preferred embodiments of the invention have been described, modifications can be made and other embodiments may be devised without departing from the spirit of the invention and the scope of the appended claims.

What is claimed is:

1. A musculature exercising device which comprises:

a U-shaped grab-bar having a central portion, and two parallel arms projecting in a common orthogonal direction from opposite ends of said central portion; and a harness comprising a plurality of straps for suspending said grab-bar against a vertical structure;

wherein said harness comprises:

a first strap attached at a proximate end to a median area of said central portion;

a second strap attached at a proximate end to a first one of said arms; and a third strap attached at a proximate end to a second one of said arms.

2. The device of claim 1, wherein said straps are joined together about distal ends.

3. The device of claim 2, wherein said straps are dimensioned and positioned to maintain said central portion and arms in a substantially horizontal position whether said central portion or distal ends of portions of said arms are nearest said vertical surface.

4. A musculature exercising device which comprises:

a U-shaped grab-bar having a central portion, and two parallel arms projecting in a common orthogonal direction from opposite ends of said central portion; and a harness comprising a plurality of straps for suspending said grab-bar against a vertical structure;

wherein said harness comprises:

a first strap attached at a proximal end to said bar near the junction of said central portion and a first one of said arms;

a second strap attached at a proximal end to a distal portion of said arm;

a third strap attached at a proximal end to said bar near the junction of said central portion and a second one of said arms; and a fourth strap attached at a proximal end to a distal portion of said second arm.

5. The device of claim 4, wherein said straps are dimensioned and positioned to maintain said central portion and arms in a substantially horizontal position whether said central portion or said distal ends of the arm are nearest said vertical structure.

6. A musculature exercising method using the device of claim 1 which comprises:

suspending said grab-bar to a height substantially equal to a user's shoulder height;

grabbing said grab-bar with both hands while leaning backward against said vertical surface;

flexing knee until arms are fully extended;

raising oneself to a substantially standing position by flexing elbows and unflexing knees; and repeatedly perform said steps of flexing and raising.

* * * * *